US006802283B2

(12) United States Patent
Liederman et al.

(10) Patent No.: US 6,802,283 B2
(45) Date of Patent: Oct. 12, 2004

(54) ENGINE COOLING SYSTEM WITH VARIABLE SPEED FAN

(75) Inventors: Keith E. Liederman, Brighton, MI (US); Davide F. Piccirilli, Livonia, MI (US); Matti K. Vint, Canton, MI (US); Joseph V. Bejster, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 6 days.

(21) Appl. No.: 10/201,135

(22) Filed: Jul. 22, 2002

(65) Prior Publication Data

US 2004/0011306 A1 Jan. 22, 2004

(51) Int. Cl.[7] ..... F01P 7/02

(52) U.S. Cl. ..... 123/41.12; 123/41.46; 192/21.5; 192/58.61; 62/133

(58) Field of Search ..... 123/41.12, 41.46, 123/41.47; 192/58.61, 21.5; 62/133

(56) References Cited

U.S. PATENT DOCUMENTS

| | | | | |
|---|---|---|---|---|
| 4,064,980 A | * | 12/1977 | Tinholt | 192/58.682 |
| 4,074,662 A | * | 2/1978 | Estes | 123/41.12 |
| 4,222,353 A | * | 9/1980 | Abe et al. | 123/41.12 |
| 4,228,880 A | * | 10/1980 | Gee | 192/58.61 |
| 4,310,084 A | | 1/1982 | Nonnenmann | |
| 4,310,085 A | | 1/1982 | LaFlame | |
| 4,337,733 A | | 7/1982 | Hirata et al. | |
| 4,549,505 A | | 10/1985 | Hirano et al. | |
| 4,624,221 A | | 11/1986 | Fujigaya et al. | |
| 4,650,045 A | * | 3/1987 | Weible et al. | 192/58.61 |
| 4,658,766 A | | 4/1987 | Hirano | |
| 4,785,874 A | | 11/1988 | Avrea | |
| 4,836,147 A | | 6/1989 | Morris | |
| 4,987,986 A | * | 1/1991 | Kennedy et al. | 192/58.61 |
| 5,076,216 A | * | 12/1991 | Ro | 123/41.46 |
| 5,307,644 A | * | 5/1994 | Cummins et al. | 62/133 |
| 5,415,134 A | * | 5/1995 | Stewart, Jr. | 123/41.01 |
| 5,482,432 A | * | 1/1996 | Paliwoda et al. | 415/168.2 |
| 5,561,243 A | | 10/1996 | Machida | |
| 5,619,957 A | | 4/1997 | Michels | |
| 5,836,269 A | | 11/1998 | Schneider | |
| 5,868,105 A | | 2/1999 | Evans | |
| 5,957,663 A | * | 9/1999 | Van Houten et al. | 417/13 |
| 6,032,618 A | | 3/2000 | Ferrari et al. | |
| 6,109,219 A | | 8/2000 | Sano | |
| 6,135,067 A | | 10/2000 | Klamm et al. | |
| 6,173,823 B1 | * | 1/2001 | Moser et al. | 192/21.5 |
| 6,223,700 B1 | | 5/2001 | Sano et al. | |
| 6,340,006 B1 | | 1/2002 | Malatto et al. | |
| 6,374,780 B1 | | 4/2002 | Rutyna et al. | |
| 2001/0020452 A1 | | 9/2001 | Suzuki et al. | |

FOREIGN PATENT DOCUMENTS

| | | |
|---|---|---|
| FR | 2 455 174 | 11/1980 |
| FR | 2456838 | 12/1980 |
| JP | 60022020 | 2/1985 |
| WO | WO 98/53188 | 11/1998 |

OTHER PUBLICATIONS

James E. Duffy, *Modern Automotive Technology*, 2000, pp. 706–707.

* cited by examiner

*Primary Examiner*—Tony M. Argenbright
*Assistant Examiner*—Katrina B. Harris

(57) ABSTRACT

An engine cooling system and method that will allow an engine cooling fan to be driven independently of the engine speed. The engine cooling fan is driven by the engine crankshaft, but includes an electronically controllable fan clutch between the fan and the crankshaft. A control module electronically controls the engagement of the fan clutch based upon engine and vehicle operating conditions. A water pump for pumping coolant through the engine cooling system may also be driven by the crankshaft of the engine, but with an electronically controlled pump clutch between the engine crankshaft and the water pump.

20 Claims, 2 Drawing Sheets

ENGINE COOLING SYSTEM WITH VARIABLE SPEED FAN

BACKGROUND OF INVENTION

The present invention relates to a cooling control system and a cooling control method for cooling an engine of, for example, a vehicle.

Conventionally, in a vehicle engine, a cooling circuit employing a radiator is used to remove excess heat from the engine, maintain a constant operating temperature, increase the temperature in a cold engine quickly, and heat the passenger compartment. The cooling circuit includes a coolant, which is typically a mixture of water and anti-freeze (such as ethylene glycol). The cooling circuit includes a water (i.e. coolant) pump that is powered via the crankshaft of the engine, usually through a pulley and belt assembly or a gear set connected between the crankshaft and the pump, so its speed varies with the speed of the engine. The water pump forces coolant through the engine and other system components in order to prevent overheating of the engine. Also, when it is desirable to heat the passenger compartment, it pumps coolant through a heater core. When the engine is started cold, the coolant is below the optimum temperature for engine operation and it does not contain enough heat for transferring to the passenger compartment. In order to more quickly warm up such an engine system, then, a thermostat is used to redirect the flow of the coolant through a radiator bypass until the coolant is up to the desired temperature range. Once up to temperature, the coolant is routed through the radiator to assure that the temperature is maintained in the desirable range, and can be routed through the heater core to heat the passenger compartment.

In order to improve the heat transfer efficiency of the radiator, these conventional types of systems also employ a radiator fan, mounted adjacent to the radiator, to draw air through the radiator in order to better cool the coolant. The radiator fan is also typically powered via the crank shaft, so its speed is also varied as the speed of the crankshaft changes. While this conventional type of cooling system is straight forward and relatively easy to implement, it is not very good at providing the optimum cooling for the particular engine and vehicle operating conditions-particularly since the water pump and fan speed are only a function of the engine speed, not any other factors important to maintaining the desired coolant temperature.

More recently, advanced engine cooling systems have been developed that will more precisely control the engine cooling. A more advanced system may be, for example, a system and method as described in U.S. Pat. No. 6,374,780, assigned to the assignee of this application, and incorporated herein by reference. These newer systems take into account additional factors that influence both what the desired coolant temperature is and how it is achieved. Such a system might include a radiator that receives the coolant flowing out of the engine, cools the coolant and returns it to the engine; a bypass circuit for making the coolant flowing out of the engine bypass the radiator when the coolant is below the desired temperature; a fan that is driven by a motor so that its speed can be controlled to be optimum for the particular engine and vehicle conditions (independent of the engine speed); an electronically controlled flow rate control valve (or valves) for regulating the percentage of coolant bypassing the radiator; and a water pump that is either conventionally driven via the crankshaft or by an electric motor, with the electric motor controlled water pump precisely controlled to provide a desired coolant flow rate for the particular engine and vehicle operating conditions. Thus, the engine cooling system can be precisely controlled and the heating, ventilation and air conditioning (HVAC) performance optimized by controlling the coolant mass flow rate, the air mass flow rate, and the coolant flow path by one overall control strategy.

However, these advanced engine cooling systems have a drawback in that they require substantially more electric power consumption than the conventional systems. The electrically controlled valve, electrically controlled fan, and when employed, the electrically controlled water pump all draw additional electrical power.

Moreover, many additional electronic components are typically found on modern vehicles, which pushes the limit on the electrical current available from the vehicle charging system. This is particularly a concern with vehicle charging systems employing a conventional 12V electrical system rather than a high voltage system, such as 42 volts. And, in particular, pick-up trucks, sport utilities and other larger vehicles in the light vehicle class that run on 12 volts require more electrical power for the fan and water pump than typical passenger cars, so the current draw is even greater.

Thus, it is desirable to have an engine cooling system that overcomes the drawbacks of the conventional systems, while minimizing the additional electrical power needed to operate this system.

SUMMARY OF INVENTION

In its embodiments, the present invention contemplates a cooling system for controlling the temperature of an engine, with the engine having a rotating member. The cooling system includes a radiator, and an accessory drive adapted to be driven by the rotating member. The system also includes a fan clutch having an input member operatively engaging the accessory drive and an output member selectively engagable with the input member, and with the fan clutch electronically controllable to select the amount of engagement between the input member and the output member. A fan is located adjacent to the radiator and operatively engages the output member to be driven thereby. And, a controller actuates the clutch to thereby adjust the amount of engagement between the input member and the output member according to predetermined operating conditions.

The present invention further contemplates a method of cooling an engine, having a rotating member and a radiator, in a vehicle, the method comprising the steps of: driving an accessory drive with the rotating member; driving a fan clutch input shaft with the accessory drive; monitoring predetermined engine and vehicle operating conditions; selectively changing the degree of engagement of a fan clutch output shaft with the fan clutch input shaft based on the engine and vehicle operating conditions; and driving fan blades adjacent to the radiator with the fan clutch output shaft.

An advantage of the present invention is that an electronically controllable clutched engine cooling fan reduces the electrical power draw of a motor driven cooling fan, allowing an advanced engine cooling system to be employed without the need to greatly increase a vehicle charging system capacity.

Another advantage of the present invention is that the torque transfer to the engine fan blades can be eliminated when it is undesirable to operate the fan.

A further advantage of the present invention is that a water pump can also be driven via the crankshaft through an electronically controlled clutch in order to further reduce the electrical requirements for an engine cooling system.

DETAILED DESCRIPTION

Figure 1:
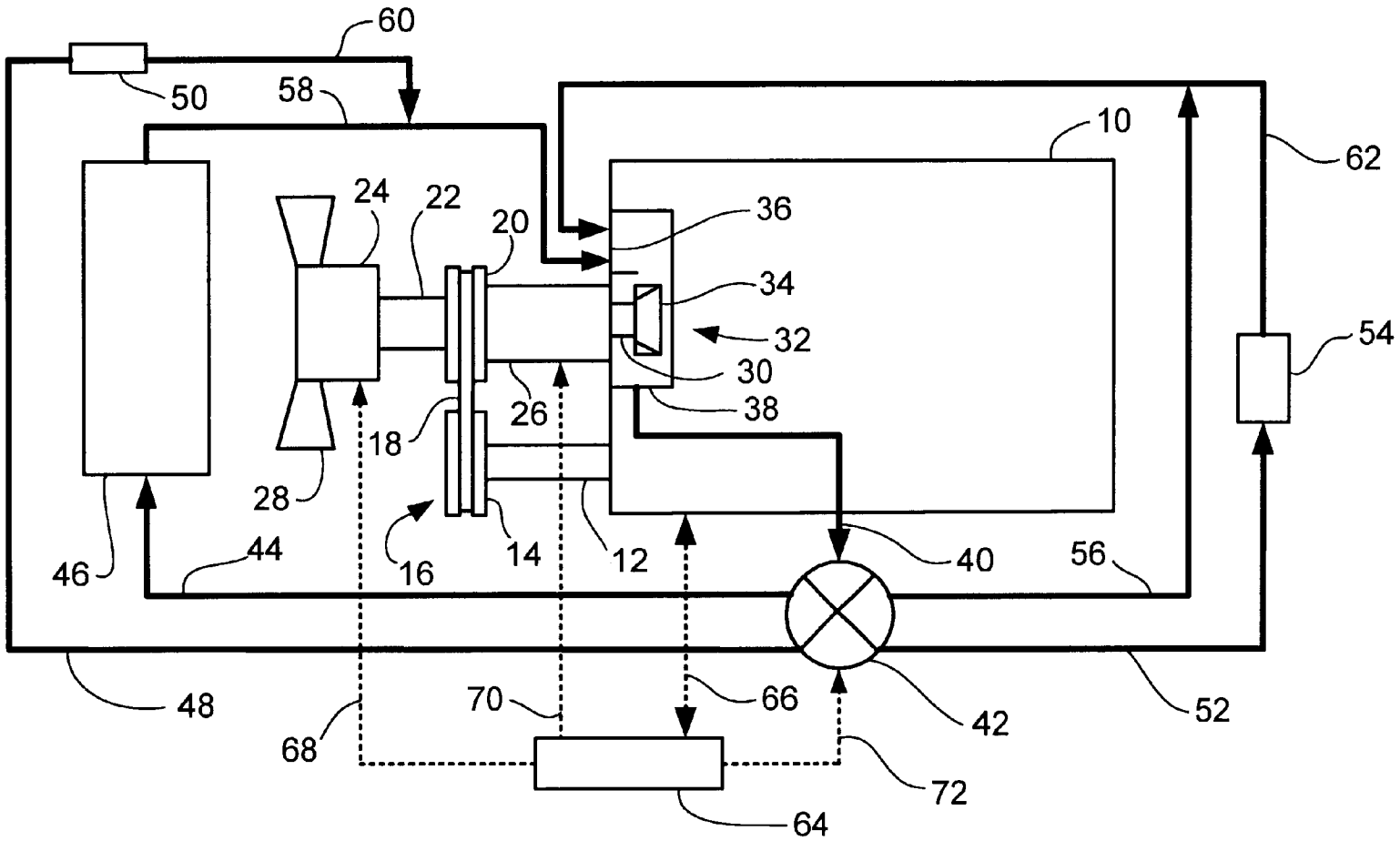
FIG. 1 is a schematic view of a vehicle engine and cooling system in accordance with the present invention.

FIG. 1 illustrates an engine 10, which may be employed for example in a vehicle. The engine includes a crankshaft 12, which not only provides power for locomotion of the vehicle, but is also connected to a crankshaft pulley 14 of a front end accessory drive 16. The crankshaft pulley 14 is coupled to a drive belt 18. The drive belt 18 is also coupled to a driven pulley 20 of the front end accessory drive 16. While a pulley and belt assembly is shown, a different assembly for transferring torque, such as, for example, a gear set may also be employed.

The driven pulley 20 is mounted on an input shaft 22. The input shaft 22 is connected at one end to an input to an electronically controlled viscous clutch 24 for a fan and at its other end to an electronically controlled viscous clutch 26 for a pump. While the clutches are preferably viscous clutches (clutches that transfer torque by shearing a fluid), other types of electronically controllable clutches that are generally continuously variable between the engaged and disengaged states can also be employed. An output to the fan clutch 24 connects to and drives a set of fan blades 28. An output to the pump clutch 26 connects to and drives a water pump shaft 30 of a water pump 32, with the shaft 30 connected to a water pump impeller 34.

The pump 32 includes an inlet 36 and an outlet 38. The outlet 38 connects to flow passages in the engine 10, which then connect to a coolant passage 40 leading to an inlet of an electronically controlled, four-way valve 42. The coolant passages are illustrated herein by heavy lines with arrows indicating the direction of the coolant flow. The four way valve has four outlets to which the inlet can selectively connect. A first outlet leads through a radiator coolant inlet passage 44 to a radiator 46, a second outlet leads through a degas coolant inlet passage 48 to a degas container 50, a third outlet leads through a heater coolant inlet passage 52 to a heater core 54, and a fourth outlet leads through a by-pass coolant passage 56.

The radiator 46 also connects to a radiator coolant outlet passage 58 that leads to the water pump inlet 36. The degas container 50 also connects to a degas coolant outlet passage 60 that leads to the radiator coolant outlet passage 58. A heater coolant outlet passage 62 extends from the heater core 54 to the water pump inlet 36, with the by-pass coolant passage connecting to the heater outlet passage 62.

A control module 64 is electrically connected to the engine cooling system in order to monitor and control the engine cooling process. The control module 64 communicates with various subsystems on the engine 10 through various electrical connections 66. The electrical connections are illustrated herein by dashed lines. The control module 64 also has an electrical connection 68 to the fan clutch 24, an electrical connection 70 to the pump clutch 26, and an electrical connection 72 to the four way valve 42.

The engine cooling system controls the fan blades 28 by the control module 64 regulating the fan clutch 24. The crankshaft 12 transfers torque to the crankshaft pulley 14, which, in turn transfers torque to the driven pulley 20 through the drive belt 18. The driven pulley 20 transfers the torque to the input shaft 22. The input shaft 22 transfers torque to the input to the fan clutch 24. The fan clutch 24 includes an input and an output (not shown), with a viscous shear fluid between the two. The control module 64 opens and closes a valve (not shown) in the clutch 24, with the valve controlling the level of viscous shear fluid between the input and output clutch plates. Depending upon the fluid level, there may be very little or no torque that is transferred from the input to the output, so the fan blades 28 are not driven off of the pulley 20, or a large torque transfer, thus driving the fan blades 28 up to the speed of the pulley 20. The amount of electrical power transferred from the control module 64 to the fan clutch 24 does not have to be large since this power is only needed to control the valve—the actual torque driving the fan blades 28 is produced by the engine 10.

This configuration allows for continuously variable fan speed at or below the driven pulley speed. So, by controlling the fan clutch 24, the fan speed can be maintained at the desired rotational velocity, even with variations in engine speed. In order to assure that the desired fan speed can be maintained for the various engine and vehicle operating conditions, the pulley ratio can be set so that the necessary fan speed (and water pump speed) can be achieved throughout the desired engine operating range. Further, the fan blades 28 can be stopped when it is undesirable to draw additional air through the radiator 46. The control strategy for the fan 28 is preferably not an open loop correlation, like that typically employed with a motor driven fan, since it may be desirable to have the fan 28 run at a particular speed even with variations in engine speed. Consequently, the control module 64 will require an engine speed input in addition to the inputs that determine the desired fan speed for engine cooling.

The engine cooling system controls the water pump impeller 34 by the control module 64 regulating the pump clutch 26. The crankshaft 12 transfers torque to the crankshaft pulley 14, which, in turn transfers torque to the driven pulley 20 through the drive belt 18. The driven pulley 20 transfers the torque to the input shaft 22. The input shaft 22 transfers torque to the input to the pump clutch 26. The pump clutch 26 includes an input and an output, with a viscous shear fluid between the two. The input and output are biased toward one another such that, when the control module 64 supplies no electrical power to the pump clutch 26, maximum torque is transferred from the input to the output, so the pump impeller 34 is driven at essentially the driven pulley speed. On the other hand, when the control module 64 supplies power to the pump clutch 26, the input and output are pulled farther apart, so the viscous shearing of the fluid will transfer less torque. The greater the power supplied, the farther the input and output are pulled apart, and so the lower the torque transfer. The control module 64 is programmed to disengage the pump clutch 26 to a point where the water pump 32 is pumping some predetermined minimum amount of water through the engine 10 so that, even if the coolant temperature is low, the coolant will flow enough to assure that no damage causing hot spots will occur within the engine 10.

The pump clutch 26 operates the opposite of the fan clutch 24 so that, should the control module 64 fail to signal the pump clutch 26, the water pump 32 will still force water through the system in order to assure that the engine 10 does not overheat. Once again, the amount of electrical power transferred from the control module 64 does not have to be large since this power is only needed to pull the input and output farther apart—the actual torque driving the pump impeller 34 is produced by the engine 10. Also, one will note that, while the fan blades 28 and water pump impeller 34 are driven by the same input shaft 22, the output speed of each can be independently controlled.

The operation of the engine cooling system will now be described. The control module 64 monitors and adjusts the engine temperature by using multiple inputs from an engine control system and other sensors to constantly minimize the current temperature error from the currently desired operating temperature. The factors for determining the current desired engine temperature may be the engine load, ambient environmental conditions, passenger compartment heat demand, and other vehicle operating conditions, such as, for example, air conditioning head pressure, ambient air temperature, vehicle speed, heater demand in the passenger compartment, throttle position, engine speed, and ignition key position. The particular engine temperature being targeted may be coolant temperature or cylinder head temperature, as is desirable for the particular engine cooling system.

Preferably, the control module 64 uses a hierarchy to minimize the overall energy consumption of the cooling system while achieving and maintaining the currently desired operating temperature. For example, if the engine temperature is too high, the control module 64 first adjusts the flow control valve 42 to provide more flow to the radiator 46. Then, if needed, it will increase the speed of the water pump 32 by reducing power to the pump clutch 26. And finally, if still more cooling is needed, the control module 64 will increase the speed of the fan 28 by increasing power to the fan clutch 24. Generally, the fan 28 is only employed when the water pump cooling capability is at its maximum since the fan 28 is not as efficient at removing heat (per energy input to the fan assembly) as is the water pump 32. The position of the flow control valve 42, and hence the routing of the coolant, is controlled by signals from the control module 64. The valve 42 controls the percentage of coolant transferred through the radiator 46, by-pass line 56, degas container 50, and heater core 54.

For engine cooling operation when the coolant temperature is too low, such as with a cold start, for example, the control module 64 will bring the engine temperature up quickly by energizing the pump clutch 26 to minimize the coolant flow, adjusting the flow control valve 42 to send the coolant through the by-pass 56 rather than the radiator 46, and de-energizing the fan clutch 24 in order to stop the fan. Thus, an overall control of the engine temperature and heating system control can be obtained while minimizing the additional electrical load on the vehicle electrical system.

There is an additional, optional control strategy that may be employed with the fan clutch 24. When the engine and vehicle operating conditions are such that it is desirable to have a fan speed that is close to the driven pulley speed, the control module 64 can vary the power to the fan clutch 24 slightly so that clutch lock-up is avoided. This is because the nature of some of the viscous types of clutches are such that, when the desired output speed of the clutch 24 is close to the input speed of the clutch 24, the output speed is drawn off the desired speed and ends up matching the input speed—therefore, the control logic in the control module 64 will compensate for this condition.

Figure 2:
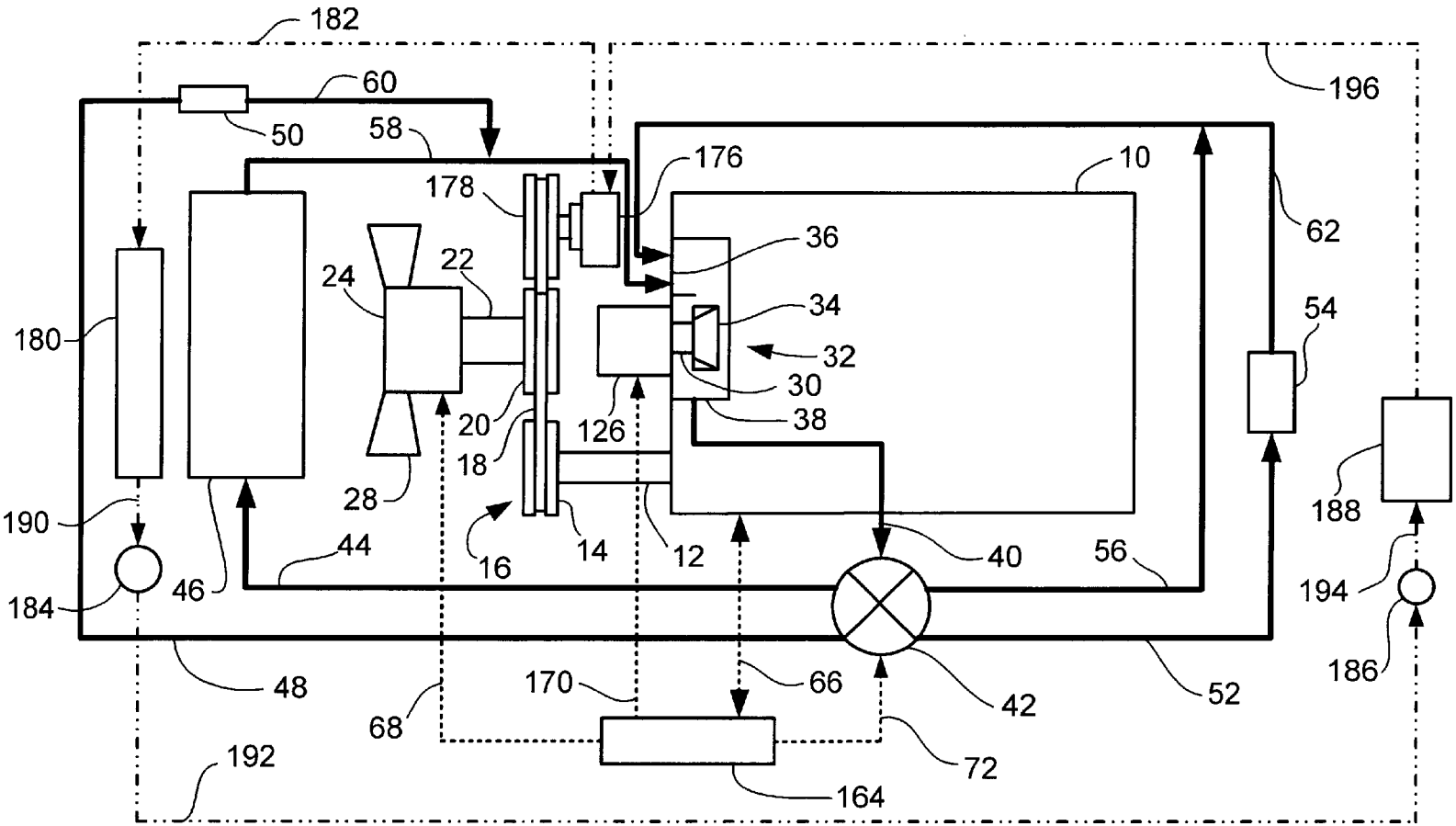
FIG. 2 is a view similar to FIG. 1, but illustrating an alternate embodiment.

FIG. 2 illustrates an alternate embodiment of the present invention. Since most of the components are unchanged from the first embodiment, these are referred to by the same element numbers—only the modified or added elements are given 100-series element numbers. In this embodiment, the water pump 32 is driven by an electric motor 126, which is controlled by the control module 164 via electrical connection 170. While this configuration will have more overall electrical power draw than the first embodiment, it provides for additional control over the water pump operation. This embodiment also illustrates a vehicle that includes an air conditioning system. This system has a refrigerant compressor 176, driven by the crankshaft pulley 14 via a compressor pulley 178. The compressor 176 connects to a condenser 180, via a refrigerant line 182. In FIG. 2, refrigerant lines are illustrated as dot-double-dash lines. The condenser 180 is mounted adjacent to the radiator 46 so that air drawn through the radiator 46 by the fan 28 will also be drawn through the condenser 180. The refrigerant system also includes a receiver/dryer 184, expansion valve 186, and evaporator 188, connected by refrigerant lines 190, 192, 194 and 196 respectively.

The operation of this engine cooling system is very similar to that in the first embodiment, with two main differences. First, the control module 164 will send increasing power to the pump motor 126 to increase the impeller speed, rather than sending less power, as was the case with the viscous clutch in the first embodiment. Also, the control module 164 may start the fan 28, when needed for the air conditioning system condenser 180, even though the fan 28 is not needed at that time for engine coolant cooling. The control module 164 can then adjust the water pump speed and/or the flow control valve 42 to account for the increased cooling effect of the fan 28 on the engine coolant.

While certain embodiments of the present invention have been described in detail, those familiar with the art to which this invention relates will recognize various alternative designs and embodiments for practicing the invention as defined by the following claims.

What is claimed is:

1. A cooling system for controlling the temperature of an engine, with the engine having a rotating member, the cooling system comprising:

a radiator;

an accessory drive adapted to be driven by the rotating member;

a fan clutch having an input member operatively engaging the accessory drive and an output member selectively engagable with the input member, and with the fan clutch electronically controllable to select the amount of engagement between the input member and the output member;

a fan located adjacent to the radiator and operatively engaging the output member to be driven thereby;

a controller actuating the clutch to thereby adjust the amount of engagement between the input member and the output member according to predetermined operating conditions;

a pump clutch having a pump input operatively engaging the accessory drive and a pump output selectively engagable with the pump input, and with the pump clutch electronically controllable by the controller to select the amount of engagement between the pump input and the pump output; and a water pump adapted to be located adjacent to the engine and operatively engaging the pump output to be driven thereby.

2. The cooling system of claim 1 wherein the input member of the fan clutch is engagable with the output member through viscous shear.

3. The cooling system of claim 1 wherein the engine includes a coolant outlet; and wherein the cooling system further includes a flow control valve having an inlet adapted to be in fluid communication with the coolant outlet of the engine, a first outlet in fluid communication with the radiator, a second outlet adapted to be in fluid communication with the engine, and a flow director for selectively controlling the degree of fluid communication between the flow control valve inlet and the first and the second outlets, and with the flow director electrically connected to the controller to be controlled thereby.

4. The cooling system of claim 3 wherein the flow control valve includes a third outlet that is selectively in fluid communication with the flow control valve inlet through the flow director; and wherein the cooling system further includes a heater core in fluid communication with the third outlet.

5. The cooling system of claim 3 wherein the flow control valve includes a third outlet that is selectively in fluid communication with the flow control valve inlet through the flow director; and wherein the cooling system further includes a degas container in fluid communication with the third outlet.

6. The cooling system of claim 1 wherein the controller adjusts the engagement of the input member relative to the output member based upon a desired speed of the fan relative to an engine speed.

7. The cooling system of claim 1 wherein the rotating member is an engine crankshaft.

8. The cooling system of claim 1 wherein the input member and the output member of the fan clutch are adapted to be substantially fully disengaged when the controller does not actuate the clutch.

9. A cooling system for a liquid cooled engine having a rotating member, the cooling system comprising:

a flow control valve having a valve inlet adapted to receive coolant from the engine, and a first valve outlet, a second valve outlet and a third valve outlet, with the valve controllable to control the degree of fluid communication between the valve inlet and each of the first, second and third valve outlets;

a water pump having a pump inlet for receiving coolant and a pump outlet for pumping coolant through the cooling system;

a radiator having a radiator inlet for receiving coolant flowing out of the first valve outlet, and a radiator outlet for returning the coolant to the pump inlet;

a coolant bypass connected between the second valve outlet and the pump inlet;

a heater core having a heater inlet for receiving coolant from the third valve outlet, and a heater outlet for returning coolant to the pump;

an accessory drive adapted to be driven by the rotating member;

a fan clutch having an input member operatively engaging the accessory drive and an output member selectively engagable with the input member, and with the fan clutch electronically controllable to select the amount of engagement between the input member and the output member;

a fan located adjacent to the radiator and operatively engaging the output member to be driven thereby; and a controller operatively engaging the fan clutch for controlling the engagement of the clutch output relative to the clutch input, and for controlling the degree of fluid communication between the valve inlet and each of the first, second and third valve outlets.

10. The cooling system of claim 9 further including a degas container having an inlet and an outlet for returning coolant to the pump; and wherein the flow control valve includes a fourth valve outlet for directing fluid to the degas container inlet whereby the controller will control the degree of fluid communication between the valve inlet and the fourth valve outlet.

11. The cooling system of claim 9 wherein the input member of the fan clutch is engagable with the output member through viscous shear.

12. The cooling system of claim 11 wherein the input member and the output member of the fan clutch are adapted to be substantially fully disengaged when the controller does not actuate the clutch.

13. A method of cooling an engine, having a rotating member and a radiator, in a vehicle, the method comprising the steps of:

driving an accessory drive with the rotating member;

driving a fan clutch input shaft with the accessory drive;

monitoring predetermined engine and vehicle operating conditions;

selectively changing the degree of engagement of a fan clutch output shaft with the fan clutch input shaft based on the engine and vehicle operating conditions;

driving fan blades adjacent to the radiator with the fan clutch output shaft;

driving a water pump input shaft with the accessory drive;

selectively changing the degree of engagement of a water pump output shaft with the water pump input shaft based on the engine and vehicle operating conditions; and driving a water pump impeller with the water pump output shaft.

14. The method of claim 13 wherein the step of selectively changing the degree of engagement of the water pump output shaft includes: engaging the water pump output shaft with the water pump input shaft through a viscous shearing of fluid.

15. The method of claim 13 further including the steps of:

locating a condenser, of an air conditioning system, adjacent to the radiator;

monitoring the air conditioning system operation; and selectively changing the degree of engagement of the fan clutch output shaft with the fan clutch input shaft based on the air conditioning system operation.

16. The method of claim 13 further including varying the degree of engagement of the fan clutch output shaft to the fan clutch input shaft when the degree of engagement is close to full engagement to thereby avoid a clutch lock-up condition.

17. The method of claim 13 wherein the step of selectively changing the degree of engagement includes: engaging the fan clutch output shaft with the fan clutch input shaft through a viscous shearing of fluid.

18. A cooling system for controlling the temperature of an engine, with the engine having a rotating member and a coolant outlet, the cooling system comprising:

a radiator;

an accessory drive adapted to be driven by the rotating member;

a fan clutch having an input member operatively engaging the accessory drive and an output member selectively engagable with the input member, and with the fan clutch electronically controllable to select the amount of engagement between the input member and the output member;

a fan located adjacent to the radiator and operatively engaging the output member to be driven thereby;

a controller actuating the clutch to thereby adjust the amount of engagement between the input member and the output member according to predetermined operating conditions; and a flow control valve having an inlet adapted to be in fluid communication with the coolant outlet of the engine, a first outlet in fluid communication with the radiator, a second outlet adapted to be in fluid communication with the engine, and a flow director for selectively controlling the degree of fluid communication between the flow control valve inlet and the first and the second outlets, and with the flow director electrically connected to the controller to be controlled thereby.

19. The cooling system of claim 18 wherein the flow control valve includes a third outlet that is selectively in fluid communication with the flow control valve inlet through the flow director; and wherein the cooling system further includes a heater core in fluid communication with the third outlet.

20. The cooling system of claim 18 wherein the flow control valve includes a third outlet that is selectively in fluid communication with the flow control valve inlet through the flow director; and wherein the cooling system further includes a degas container in fluid communication with the third outlet.

* * * * *